United States Patent [19]

Koehler, Jr.

[11] Patent Number: 5,076,711

[45] Date of Patent: Dec. 31, 1991

[54] COLLAPSIBLE CONTAINER

[75] Inventor: Ronald G. Koehler, Jr., Owosso, Mich.

[73] Assignee: Noreus Products Company, Owosso, Mich.

[21] Appl. No.: 532,900

[22] Filed: Jun. 4, 1990

[51] Int. Cl.[5] ..... B65D 33/01; B65D 33/14

[52] U.S. Cl. ..... 383/67; 43/55; 62/457.1; 190/903; 383/97; 383/110

[58] Field of Search ..... 383/97, 67, 110, 66; 43/55; 62/457.1; 190/903; 150/118

[56] References Cited

U.S. PATENT DOCUMENTS

| | | | |
|---|---|---|---|
| 1,251,404 | 12/1917 | Mills | 383/67 |
| 1,819,349 | 8/1931 | Walrath | 383/97 |
| 2,166,885 | 7/1939 | Wiseman | 383/97 |
| 2,323,318 | 7/1943 | Farkas | 43/55 |
| 3,053,005 | 9/1962 | Byers | 43/55 |
| 3,428,103 | 2/1969 | Walsh | 383/97 |
| 3,724,791 | 2/1988 | McSorley | 383/97 |
| 4,537,313 | 8/1985 | Workman | 62/457.1 |

FOREIGN PATENT DOCUMENTS

| | | | |
|---|---|---|---|
| 709828 | 8/1941 | Fed. Rep. of Germany | 150/118 |

*Primary Examiner*—Stephen P. Garbe

*Attorney, Agent, or Firm*—Learman & McCulloch

[57] ABSTRACT

A collapsible, insulated storage container includes a front wall and a rear wall, each wall having a lower edge, an upper edge and two side edges. The lower edges and a portion of the side edges adjacent the lower edges are secured and sealed together to provide a pouch. The remaining portions of the side and upper edges are separably connected by a zipper for opening and closing the container. A closable drain is provided in the pouch. A flange extending from the upper edge of the rear wall is equipped with grommets to receive rotatable fasteners secured to a support structure. Straps also may be provided to secure the container to the support structure.

10 Claims, 2 Drawing Sheets

COLLAPSIBLE CONTAINER

TECHNICAL FIELD

The invention relates to a collapsible and insulated container, and particularly to a container especially adapted for use aboard a boat to store fish.

BACKGROUND OF THE INVENTION

A fishing boat conventionally is equipped with a container to store ice and fish. Such a container typically comprises a rigid box forming a permanent part of the boat and which is lined with a waterproofing material. One problem with this construction is that the box is a permanent part of the boat thereby taking up a substantial amount of space regardless of whether the box is actually being used. In order to overcome this, portable rigid chests have been utilized which may be placed in and removed from a boat depending on the need therefor. Generally, these types of chests are bulky and difficult to manipulate.

Therefore, it is desirable to provide a container which is capable of storing ice and fish, but which easily may be removed and folded in order to save space.

Collapsible, insulated bags are well known in a variety of applications. One type of bag is disclosed in U.S. Pat. No. 2,575,191 issued Nov. 13, 1951. This patent discloses a collapsible insulated bag for carrying chilled articles and has two walls secured on three sides and includes handles for carrying the bag. U.S. Pat. No. 2,748,047 issued May 29, 1956 discloses a plastic bag for carrying liquid which includes a hole in the lower portion for receiving a discharge nozzle.

Neither of these known constructions is readily cleanable on the interior nor adaptable for securing to boats.

SUMMARY OF THE INVENTION

A collapsible container constructed in accordance with the preferred embodiment of the invention comprises an insulated bag having a front wall and a rear wall in opposing relationship to accommodate a quantity of ice and fish therebetween. Each of walls include two sides, an upper edge and a lower edge. The lower edges of the walls are integrally connected and a portion of the two sides of the walls are sealed to one another to provide a pouch adjacent the bottom of the bag. A separable closure is provided between the remainder of the two sides of each of the walls and the upper edges of the walls for separably securing the walls to one another to provide access to the interior of the bag when desired. The container includes a normally closed drain in communication with the pouch for draining the latter when desired.

Each of the front and rear walls includes a layer of insulating material sandwiched between layers of moisture impervious material. The closure comprises a nylon zipper which is secured to the front and rear walls for opening and closing the container.

The container includes separable fastening means for securing the container to a supporting structure, such as a boat. A first embodiment of the fastening means utilizes a flange extending from the upper edge of the rear wall fitted with a plurality of grommets adapted to receive rotatable fasteners mounted on the transom of a boat. An alternative embodiment of the fastening means includes a plurality of loops secured to the walls of the container and a strap fed therethrough for securing the container to the supporting structure by the strap.

BRIEF DESCRIPTION OF THE DRAWINGS

A preferred embodiment of the invention is illustrated in the accompanying drawings, wherein.

DESCRIPTION OF THE PREFERRED EMBODIMENT

Figure 1:
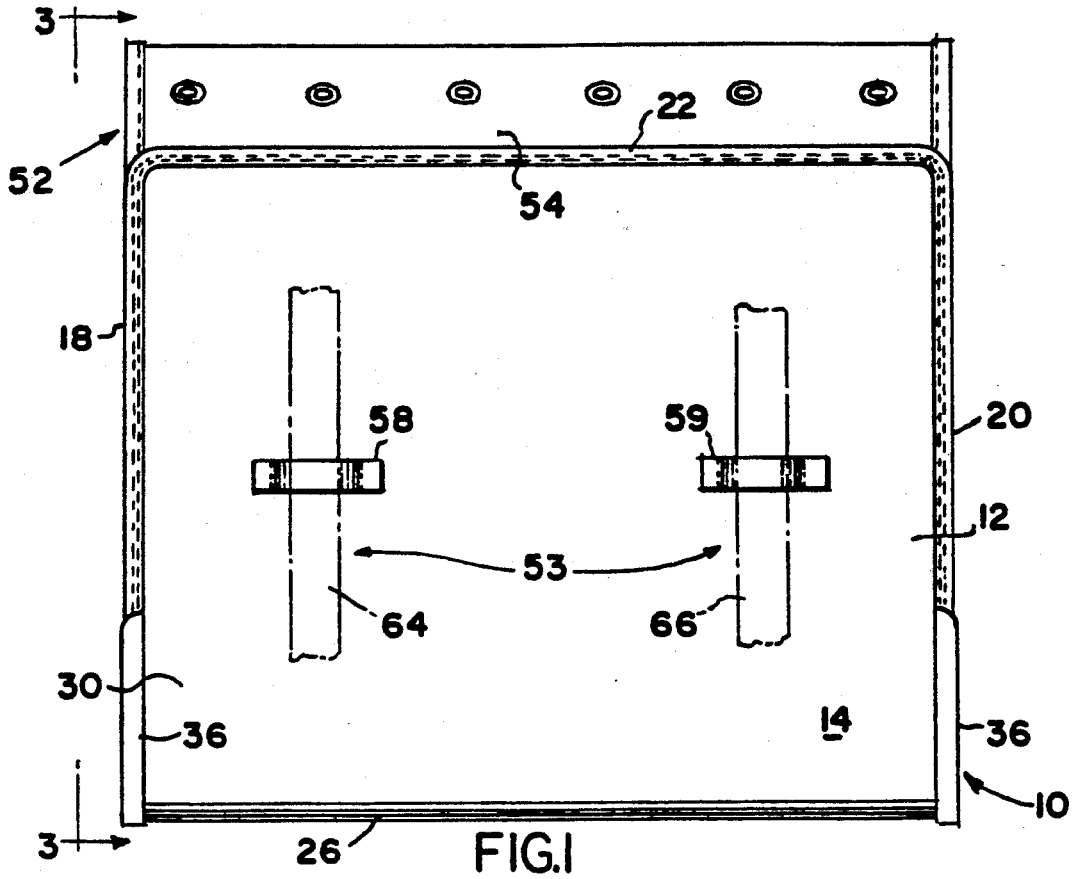
FIG. 1 is a front elevational view of the container.
Figure 2:
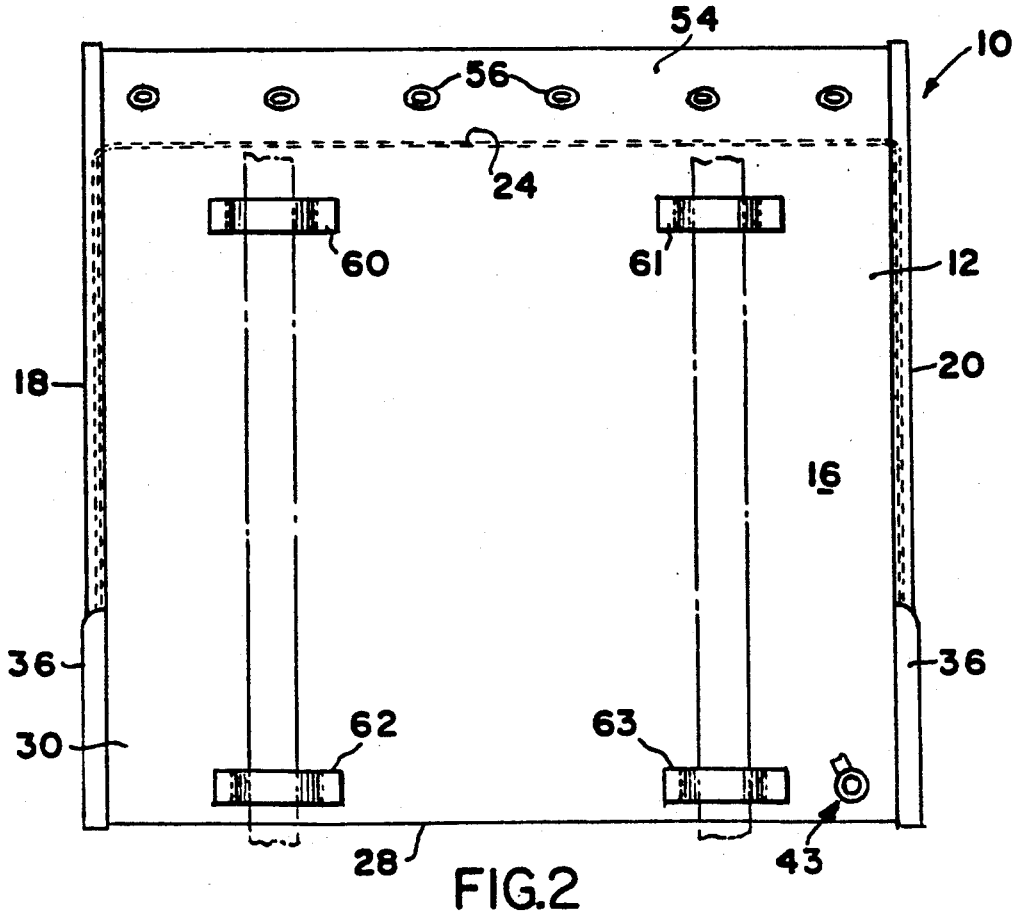
FIG. 2 is a rear elevational view of the container.
Figure 3:
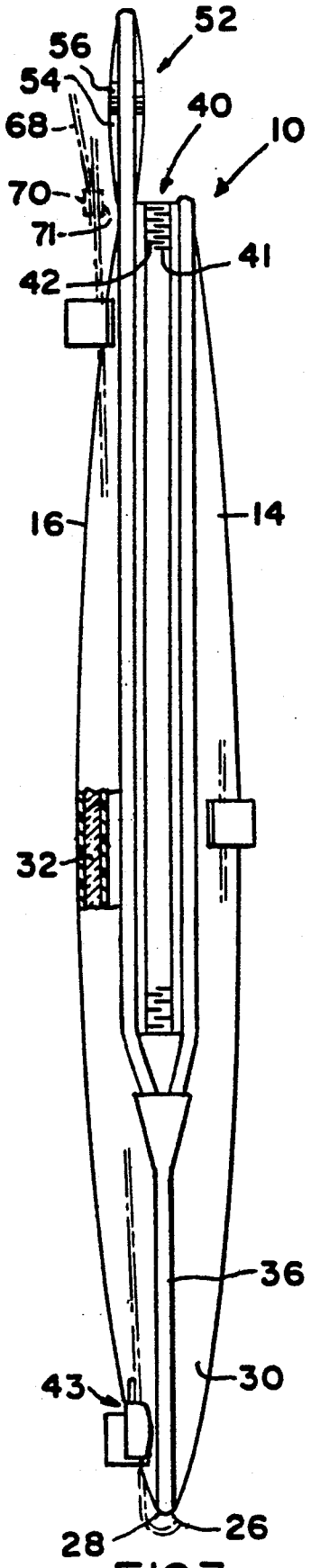
FIG. 3 is an end elevational view, partly in section.

A container constructed in accordance with the preferred embodiment is indicated generally by the reference character 10 in FIGS. 1-3. The container 10 comprises an insulated bag 12 formed from a body of sheet material transversely folded between its ends to form a front wall 14 and a rear wall 16 in overlying confronting relationship. The walls 14, 16 are generally rectangular in shape. The respective walls 14, 16 have two sides 18, 20, an upper edge 22, 24 and a lower edge 26, 28. The lower edges 26, 28 and a portion of the two sides 18, 20 of the walls 14, 16 are fixedly secured and sealed to one another providing a pouch 30. In the preferred embodiment, the front wall 14 and rear wall 16 are formed from a continuous rectangular sheet folded in half between its ends to form an integral bottom for its pouch 30.

Figure 4:
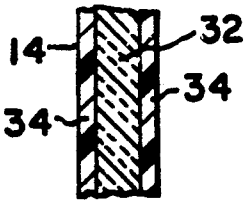
FIG. 4 is an enlarged cross-sectional view of one of the walls inward of the edge thereof.

As illustrated in FIG. 4, each of the front and rear walls 14, 16 is comprised of polyurethane or other suitable insulation layer 32 sandwiched between opposing layers of a moisture impervious material 34, such as one of the vinyls. The insulation layer 32 maintains the temperature within the container 10 substantially independent of the temperature outside the container 10. The layers of material 34 provide a liquid proof container 10.

The edges of the sheet material forming the sides 18, 20 extend beyond the insulation and are secured and sealed by folding a strip 36 of moisture impervious material over the two sides 18, 20 of both the front wall 14 and the rear wall 16. The strip 36 is secured and sealed to the respective sides by 18, 20 by heat welding or in any other suitable manner. The pouch 30 comprises approximately one third the height of the container 10.

Figure 5:
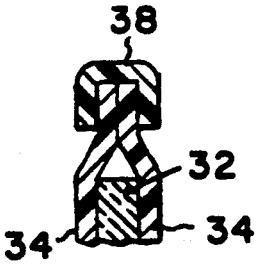
FIG. 5 is a cross-sectional view of one of the walls at an edge thereof.
Figure 6:
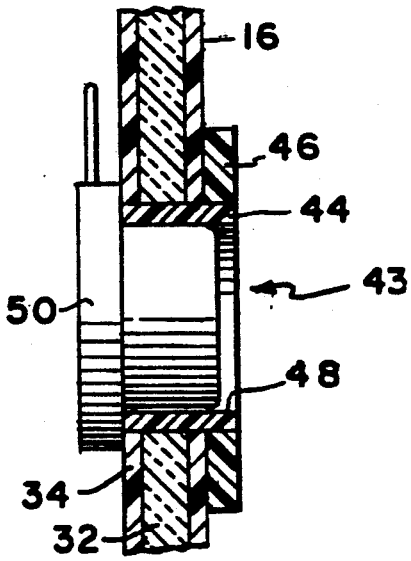
FIG. 6 is an enlarged sectional view of the drain.

The sheet material forming the upper edge 22 of the front wall 14 and the remainder of the two sides 18, 20 of the front 14 and rear 16 walls extend beyond the insulation and are finished by folding a strip 38 of moisture impervious material over each of the sides 18, 20 and upper edge 22, as illustrated in FIG. 5. The strip of material 38 is stitched, heat welded, or otherwise suitably secured to the walls 14, 16, as best illustrated in FIGS. 1 and 2, to seal the edges 18, 20, 22.

The container 10 includes separable closure means 40 between the remainder of the two sides 18, 20 of each of the walls 14, 16 and the upper edges 22, 24 of the walls 14, 16 adjacent the strips 38 of impervious material. The closure means 40 separably secures the walls 14, 16 to one another providing an enclosure and disengages to separate the walls 14, 16 to open the enclosure. The closure means 40 comprises a zipper having a first half 41 connected to the front wall 14 and a second half 42 connected to the rear wall 16. It will be understood that the provision of the pouch 30 allows for water or other moisture and articles to be retained within the container 10 though a portion or all of the zipper 40 is opened.

The container 10 also includes a drain 43 extending through one of the walls 14 or 16 in the pouch 30. The drain 43 can be opened to drain the liquid from the pouch 30 and closed to retain liquid therein. The drain 43 is preferably located at a lower corner of the rear wall 16, as illustrated in FIG. 2. The drain 43 includes a cylindrical member 44 having a radial flange 46 at one end thereof. The member 44 is accommodated in an aperture 48 provided in the rear wall 16. The flange 46 is of greater diameter than the aperture 48 and bears against the inside surface of the rear wall 16. The outer end of the cylindrical member 44 includes a cap member 50. The cap member 50 normally is closed and secured to the cylindrical member 44 to prevent liquid from flowing therethrough but may be opened to allow liquid to flow from the pouch 30. The drain 43 allows for draining of the liquid without removing the fish or other contents of the container 10, and further aids in cleaning the interior of the container.

The container 10 includes attachment means 52, 53 for securing the container 10 to a support, such as the transom of a boat. The attachment means 52, 53 may take the form of either one of two embodiments. It is to be understood that the embodiments may be used separately or together on the container 10. The first embodiment 52 comprises a flange 54 extending from the upper edge 24 of the rear wall 16. The flange 54 includes the impervious material 34, without the insulation layer 32, folded upon itself and sewn at the upper edge 24. The flange 54 includes a plurality of metal grommets 56 spaced longitudinally along the flange 54 parallel to the upper edge 24. The grommets 56 are oval and are adapted to accommodate rotatable fasteners (not shown) secured to the transom.

The second embodiment includes a first pair of parallel, side-by-side loops 58, 59 between the upper and lower edges 22, 26. The rear wall 16 includes second and third pairs of loops 60, 61 and 62, 63, each pair being in side-by-side relation. The second pair of loops 60, 61 is in the upper half of the rear wall 16 and the third pair of loops 62, 63 is located in the lower half of the rear wall 16. Both pairs of loops 60, 61 and 62, 63 are parallel to the upper 24 and lower 28 edges. A pair of straps 64, 66 slideably extend through the loops 58-63 for securing the container 10 to a support. The loops 58-63 are stitched to the walls 14, 16.

The first strap 64 is fed through a first loop of the pairs of loops 58, 60, 62. The second strap 66 is fed through a second loop of the pairs of loops 59, 61, 63. The straps 64, 66 are extended for coupling the container 10 to a supporting structure. The ends of the straps 64, 66 include securing loops 68 (one of which is indicated in FIG. 3) for encircling a post, rail, or the like of a boat for securing the container 10 to a support. Also provided are a pair of mating snaps 70, 71 at each end of the straps 64, 66.

To condition the container 10 for use, it is secured to the transom or rail of a boat so that the container 10 is upright with the wall 14 facing an occupant of the boat. The drain 43 will be closed. The closure 40 may be opened to enable a quantity of ice to be introduced to the interior of the container, following which the closure 40 may be closed.

Whenever a fish is caught, the closure 40 may be opened and the fish placed within the container 10, following which the container 10 is reclosed thereby enabling the interior of the container 10 to remain cool.

When desired, the container 10 may be removed from its support, the fish removed from the container 10, the drain 43 opened, and the contents of the pouch 30 drained. Thereafter, the container 10 may be cleaned and dried.

When the bag is not in use as a container 10, it may be folded into a compact bundle which greatly facilitates its transport and storage.

What is claimed is:

1. A collapsible container for holding fish and ice comprising:

(a) a body formed of flexible sheet material folded between its ends to form front and rear confronting walls joined together by an integral bottom, (b) said sheet material comprising a pair of overlying layers of waterproof material sandwiching a layer of insulation, (c) said layers of material having marginal edges extending beyond said insulation and being sealed together about the perimeter of said sheet material, (d) the sealed marginal edges of said front and rear walls being sealed together from said bottom in a direction away from said bottom and for a distance not more than on-third the eighth of said front wall to form a pouch adjacent said bottom, (e) said sealed marginal edges of said layers of material having separable fastening means extending from said pouch about the remaining portions of said layers of material for selectively opening and closing said container, (f) one of said walls having a drain in communication with said pouch, (g) removable closure means for selectively opening and closing said drain, and (h) securing means carried by said body for separably securing said container in an upright position to a support with said bottom lowermost.

2. The container according to claim 1 wherein said marginal edges of said layers of waterproof material are heat sealed to one another.

3. The container according to claim 1 wherein the layer of material forming said rear wall extends beyond said front wall in a direction opposite said bottom to form a flange, said securing means being carried by said flange.

4. The container according to claim 3 wherein said insulation is omitted from said flange.

5. The container according to claim 3 wherein said securing means comprises a plurality of grommets extending through said flange.

6. The container according to claim 3 wherein said securing means comprises straps, and guide loops secured to said front and said rear walls and through which the straps slideably extend.

7. The container according to claim 1 wherein said securing means comprises straps, and guide loops secured to said front and said rear walls and through which the straps slideably extend.

8. A collapsible container for holding fish and ice comprising:

(a) a body formed of rectangular flexible sheet material transversely folded between its ends to provide a bottom and integral confronting rear and front walls, (b) said sheet material comprising a pair of overlying layers of waterproof material between which a layer of insulation is sandwiched, (c) said overlying layers of waterproof material having marginal edges extending beyond said layer of insulation, (d) said marginal edges of said layers of waterproof material being accommodated in a U-shaped member secured to said layers of waterproof material to form a moisture proof seal about the perimeter of said body, (e) means permanently sealing a portion of the marginal edges of said layers of material adjacent said bottom to one another to form a pouch, (f) separable, cooperable fastening means carried by the remaining portion of said layers of material for selectively fastening and unfastening said rear and front walls to and from one another, and (g) securing means carried by said body for separably securing said container in an upright position to a support with said bottom lowermost, said securing means comprising an extension of one of said walls beyond the other of said walls, said extension having fastening means therein.

9. The container according to claim 8 wherein said separable, cooperable fastening means comprises a zipper.

10. A collapsible container for holding fish and ice comprising:

(a) a body formed of rectangular flexible sheet material transversely folded between its ends to provide a bottom and integral confronting rear and front walls, (b) said sheet material comprising a pair of overlying layers of waterproof material between which a layer of insulation is sandwiched, (c) said overlying layers of waterproof material having marginal edges extending beyond said layer of insulation, (d) said marginal edges of said layers of waterproof material being accommodated in a U-shaped member secured to said layers of waterproof material to form a moisture proof seal about the perimeter of said body, (e) means permanently sealing a portion of the marginal edges of said layers of material adjacent said bottom to one another to form a pouch, (f) separable, cooperable fastening means carried by the remaining portion of said layers of material for selectively fastening and unfastening said rear and front walls to and from one another, and (g) securing means carried by said body for separably securing said container in an upright position to a support with said bottom lowermost, said securing means comprising a pair of straps extending under said bottom and upwardly therefrom along both of said rear and front walls, and guide means secured to said rear and front walls through which said straps slideably extend.

* * * * *

UNITED STATES PATENT AND TRADEMARK OFFICE

CERTIFICATE OF CORRECTION

PATENT NO. : 5,076,711

DATED : December 31, 1991

INVENTOR(S) : Ronald G. Koehler

It is certified that error appears in the above-identified patent and that said Letters Patent is hereby corrected as shown below:

In column 4, line 26, change "on-third" to -- one-third --; same line, change "eighth" to -- height --.

Signed and Sealed this

Twentieth Day of April, 1993

*Attest:*

MICHAEL K. KIRK

*Attesting Officer*

*Acting Commissioner of Patents and Trademarks*